US009180990B2

(12) United States Patent
Rother

(10) Patent No.: US 9,180,990 B2
(45) Date of Patent: Nov. 10, 2015

(54) METHOD FOR ALLOCATING PRODUCT CARRIERS AND A FOOD PROCESSING DEVICE

(75) Inventor: Ingo Rother, Breidenbach (DE)

(73) Assignee: WEBER MASCHINENBAU GMBH BREIDENBACH, Briedenbach (DE)

( * ) Notice: Subject to any disclaimer, the term of this patent is extended or adjusted under 35 U.S.C. 154(b) by 626 days.

(21) Appl. No.: 13/586,590

(22) Filed: Aug. 15, 2012

(65) Prior Publication Data

US 2013/0042579 A1 Feb. 21, 2013

(30) Foreign Application Priority Data

Aug. 16, 2011 (DE) ..... 10 2011 110 690

(51) Int. Cl.

| | |
|---|---|
| ***B65B 25/06*** | (2006.01) |
| ***B65B 35/50*** | (2006.01) |
| ***B65B 41/08*** | (2006.01) |
| ***B65B 43/14*** | (2006.01) |

(52) U.S. Cl.

CPC ..... *B65B 25/06* (2013.01); *B65B 35/50* (2013.01); *B65B 41/08* (2013.01); *B65B 43/14* (2013.01); *B65B 43/145* (2013.01)

(58) Field of Classification Search

CPC ..... B65B 25/065
USPC ..... 53/156
See application file for complete search history.

(56) References Cited

U.S. PATENT DOCUMENTS

| | | | | |
|---|---|---|---|---|
| 3,010,499 | A * | 11/1961 | Dahms et al. | 177/121 |
| 3,269,082 | A * | 8/1966 | Bonami | 53/473 |
| 3,389,532 | A | 6/1968 | Stelzer | |
| 3,455,083 | A * | 7/1969 | Rehg | 53/74 |
| 3,780,486 | A * | 12/1973 | Jensen et al. | 53/415 |
| 4,003,184 | A | 1/1977 | Shiu | |
| 4,065,911 | A | 1/1978 | Fagan | |
| 4,328,657 | A * | 5/1982 | Brandmaier et al. | 53/586 |
| 4,342,182 | A * | 8/1982 | Dennis et al. | 53/156 |
| 4,452,031 | A * | 6/1984 | Dennis et al. | 53/586 |
| 6,772,871 | B2 * | 8/2004 | Hoeg | 198/418.1 |
| 2001/0023570 | A1 * | 9/2001 | Handel | 53/156 |
| 2009/0038913 | A1 * | 2/2009 | Malenke et al. | 198/617 |
| 2009/0188358 | A1 * | 7/2009 | Hansen et al. | 83/77 |
| 2009/0249749 | A1 | 10/2009 | Schill et al. | |
| 2010/0030373 | A1 * | 2/2010 | Lee et al. | 700/223 |

FOREIGN PATENT DOCUMENTS

| | | | |
|---|---|---|---|
| DE | 60103745 | T2 | 6/2005 |
| EP | 2025600 | A1 | 2/2009 |
| WO | WO-2011/056603 | A1 | 5/2011 |

OTHER PUBLICATIONS

Extended European Search Report dated Dec. 17, 2012; 5 pages.
Notification from the German Patent Office citing prior art dated Jul. 4, 2012; 4 pages.

* cited by examiner

*Primary Examiner* — Stephen F Gerrity
(74) *Attorney, Agent, or Firm* — Bill C. Panagos; Linda D. Kennedy; Butzel Long, PC

(57) ABSTRACT

The disclosure relates to a method for allocating product carriers, in particular L-boards, to certain types of product portions of a food product, in particular stacks of slices of a food product. During processing of the product portions, at least two different product carriers are available, of which a specific product carrier is respectively combined with the product portion in dependency of a property of a product portion. Furthermore, the disclosure relates to a food processing device.

15 Claims, 3 Drawing Sheets

METHOD FOR ALLOCATING PRODUCT CARRIERS AND A FOOD PROCESSING DEVICE

CROSS-REFERENCE TO RELATED APPLICATIONS

This application claims priority to German Patent Application 10 2011 110 690.5 filed on Aug. 16, 2011, which is hereby incorporated by reference in its entirety.

TECHNICAL FIELD

The present disclosure relates to a method for allocating product carriers, in particular L-boards to certain types of product portions of a food product, in particular stacks of slices of a food product. Furthermore, the disclosure relates to a food processing device.

BACKGROUND

It is known in prior art to arrange stacks of slices of a food product, such as, for example, ham slices, on so-called L-boards. Such an L-board comprises a base portion on which the product portion is arranged, a side portion and a cover portion, which connect in series on one side of the base portion. If the stack of slices is arranged on the base portion, the cover portion is folded over such that it partially covers the stack. The cover portion is commonly smaller in size than the base portion. The stack and the L-board arranged therearound are then together further packed. Product-specific information and a package design can be provided on the L-board. A prior art document describing L-boards and their processing is, for example, U.S. Pat. No. 5,087,498 A.

SUMMARY

Starting from prior art, it is an object of the disclosure to increase the versatility of the method and of the food processing device while still enabling economic operation.

This is achieved in that, in the method for allocating product carriers during processing of the product portions, at least two different product carriers are made available, of which a specific product carrier is respectively combined with a product portion in dependency of a property of the product portion. In this manner, at least two different end products can be produced using the method, where the property of a product portion respectively determines the kind of product carrier. Based on the different product carriers, it can then be determined further downstream in the method, which end product this is, and the individual end products can each be separately further conveyed and packaged or delivered.

The property of a product portion can in particular be the size, the weight, or a quality feature. Quality features in food products are, in particular, the fat content, the texture, the shape, or the color.

The various product carriers can differ notably in their size, shape, color, or in their imprint.

In one embodiment, the property of the product portion is detected by sensor before the product carrier is combined with the product portion. For example, the product portion can be weighed, or a property can be determined during processing of the product portion. If the product portion was for example cut by a slicer, then the cutting pressure can be detected by sensor, thereby determining the property of the product portion, presently the firmness.

Several properties of the product portion can also be detected, from which a further property is then determined.

In another embodiment, a property of the product portion is set during production, which is considered when the product carrier is combined with the product portion. Such a property can for example be the thickness of the slice, at which the slices of the product portion are cut off from a food product by a slicer. Other adjustable properties are, for example, the feed rate or the cutting speed in a slicer.

In one embodiment, the property is a size or weight of the product portion, and the at least two different product carriers have different sizes. In this manner, end products with different content can be produced using only one method, wherein for each product size is, an optimally adapted product carrier is used. If the product carriers are L-boards, in particular the size of the base portion and the cover portion can be varied when the slice size of the product portion is varied. If the number of slices or the thickness of the slices of the product portion is increased or reduced, then the length of the side portion of the L-board can be adjusted.

Advantageously, the property of the product portion is detected by means of a camera. With a camera and respective image processing software, in particular the size, especially the outline of the product portion the texture, in particular the fat content, the color or the shape of the product portion can be detected. If the product portion is a stack of slices of a food product, then the property can be detected by the camera for each individual slice, or just for a selection of slices. It is also possible to detect only the property for the uppermost slice of the product portion.

In a preferred embodiment, a stack of slices forming the product portion is cut off from a food product. A slicer is in particular used for this, which cuts slices at high speed from a food product in the form of a food bar, such as a bar of cheese, sausage or ham. The slices are then collected on a support until the desired product portion is completed and then conveyed further.

Advantageously, the product portions are transported on a conveyor device and the respective different product carriers are each provided at various locations along the conveyor device, and in dependency of the property of the respective product portion, a specific product carrier is disposed at the respective location from below underneath the product portion and further transported with the product portion. In particular at various locations in the transport process, L-boards are thus laid underneath. For example, at one location, only L-boards in one color are laid underneath, and at a location further downstream, only L-boards having a different color. The product portions having the property that they are to be combined with one of the respective product portions at the respective location then have a corresponding L-board laid underneath, while the other product portions pass this location without having any L-board laid underneath.

In an alternative embodiment, the product portions are transported on a conveyor device, where the different product carriers are provided only at one location along the conveyor device, and in dependency of the property of the respective product portion, a specific product carrier is respectively at this location placed from below underneath the product portion and further transported with the product portion. In this manner, several different product carriers can be provided at one location, which are alternatively combined with the product portions at this location. This allows for the conveyor device to be adjusted only at one location, so that product carriers can be supplied. The conveyor device can for example be interrupted for this. On the other hand, the supply of different product carriers at one location is somewhat more complex with respect to the product carrier feeder, i.e., the individual product carrier feeders need to be designed more compact.

In another alternative embodiment, the different product carriers are stored at different locations, where the product portions are relocated such that they are respectively combined with the particular product carrier of the different product carriers. In particular, the product carriers can be stored at different locations in one or more conveyor sections of a conveyor device or on different conveying devices, where the product portions are then placed on the respective product carriers. The relocation of the product portions can, for example, be effected by a gripper.

An object of the disclosure is also satisfied by a food processing device for product portions of a food product comprising a combining apparatus, in which the product portions are combined with product carriers, in particular, with L-boards. According to the disclosure, a product carrier feeder system is provided which is designed to respectively combine a certain product carrier of at least two different types of product carriers with the product portion in dependency of a property of the product portions.

The product carrier feeder system can in particular comprise independent product carrier feeders differing from each other and each providing a certain product carrier. Furthermore, one product carrier storage per product carrier feeder can be provided, or a central product carrier storage being designed to provide at least two different types of product carriers.

Here as well, a suitable product carrier can therefore be combined with the product portion in dependency of the property of the product portions.

Advantageously, a sensor device is provided which is adapted to determine a property of the product portions and to transmit it to the product carrier feeder system. The property of the product portions is in particular their size, weight, color, shape or texture. The property can in particular be determined either for the entire product portion, or for individual slices, or for all slices that are contained in the product portion.

The sensor device can for example be a weighing scale or a camera.

In one embodiment, a cutting device is provided that provides a stack of slices of a food product forming the product portions. The cutting device is in particular a slicer, which slices food bars such as cheese, sausages or ham. The property of the product portion can be determined immediately following the slicer or during the slicing process.

A sensor device can in particular be provided which is adapted to respectively determine at least one property of the individual slices during the cutting process of the cutting device, where the property of the product portion is determined from these properties. For example, a picture of each slice can be made with the camera, and from this the fat content or the texture of the slice can be computed. Furthermore, the overall fat content of the entire product portion can thereby be determined. Accordingly, a product carrier can be selected which is designed for a food product with an appropriate fat content, and in particular, contains the corresponding product information thereupon.

The cutting device can in particular be designed to vary the number of slices and/or the thickness of the slices per stack and to transmit the number of slices or the thickness of the slices in the stack as a property of the product portion to the product carrier feeder system. The property of the product portions can thereby be varied independently of sensory detection and the corresponding product carriers can be allocated to the respective product portions, so that different end products are produced.

In one embodiment, a conveyor device is provided which is adapted to transport the product portions sequentially in the conveying direction, the product carrier feeder system having one product carrier feeder for every type of product carrier, which are respectively arranged successively in the conveying direction, and designed to provide a product carrier to be combined with the product portion when a product portion passes the product carrier feeder. In this manner, at least two separate product carrier feeders are provided that can at various locations combine the product portion with the respective product carrier. This facilitates the structure of the individual product carrier feeders, but requires that the conveyor device be designed such that the product portions can be supplied at several locations. This can in particular be enabled by the fact that the conveyor device is composed of a plurality of sequentially arranged conveyor belts, and that the product carrier feeder is respectively disposed between the individual conveyor belts, and supplies the product carrier from below to the product portion, which runs from one conveyor belt to the next. Alternatively, the product carriers, however, can also be introduced or injected from the side underneath the product portions, so that the conveyor device does not need not be interrupted.

In an alternative embodiment, a conveyor device is provided which is adapted to transport the product portions sequentially in the conveying direction, where the product carrier feeder system has only one product carrier feeder being designed to provide various product carriers from different storages of product carriers in the product carrier storage. In each case, when a product portion passes by the product carrier feeder, a product carrier, which is combined with the product portion, is provided in dependency of the product portion. Thereby, the combination of product carriers with product portions thereby needs to be enabled only in one location of the conveyor device, since the product carrier feeder is adapted to supply different product carriers.

Alternatively, the product carrier feeder system can make the different product carriers available at different locations, where a relocation apparatus is provided which is designed to relocate the product portion such that it is respectively combined with the particular product carrier of the different product carriers. Different product carriers can in particular be arranged on different conveyors and the product portion is respectively arranged thereupon. The relocation apparatus used for this can in particular be a gripper on a robot arm.

The disclosure is further described below in more detail with reference to preferred embodiments.

DETAILED DESCRIPTION

Figure 1:
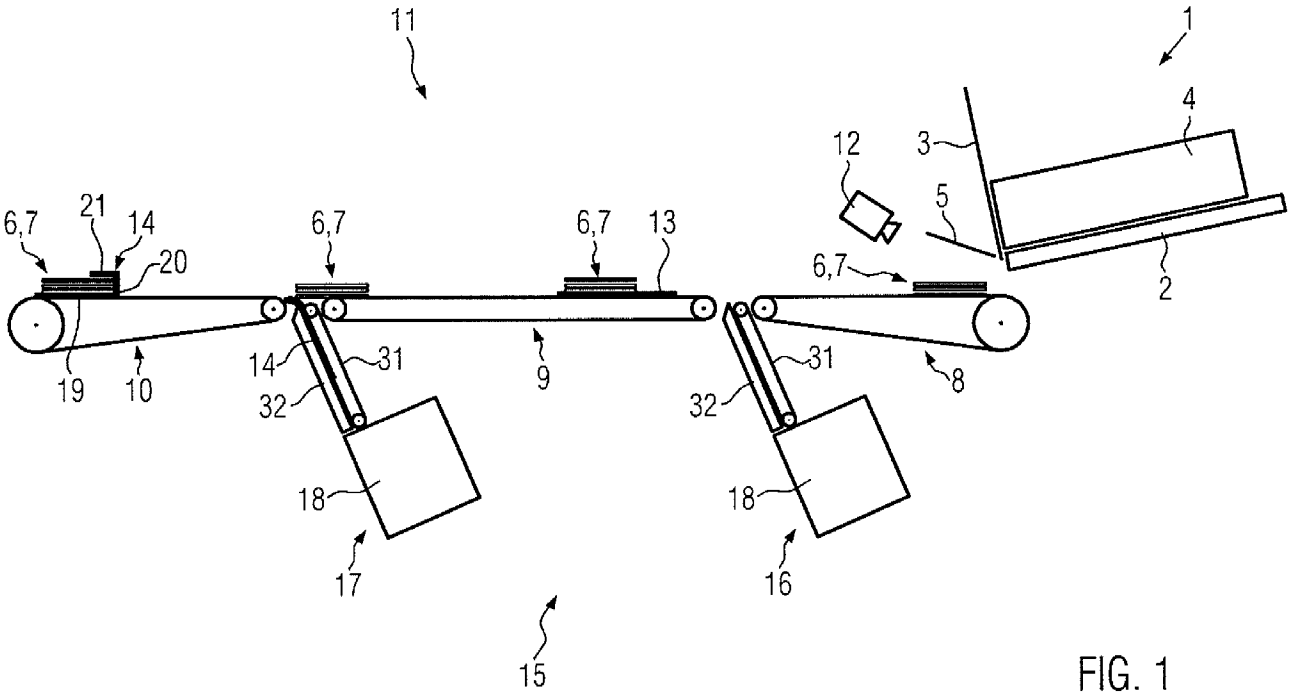
FIG. 1 shows a first embodiment of a food processing device according to the disclosure in a side view.

FIG. 1 shows an embodiment of a food processing device according to the disclosure in a schematic side view. A cutting device 1, in the form of a slicer, comprises a support 2 and a rotating cutting blade 3. A food product 4 is arranged on the support 2 and is supplied to the cutting blade 3, either by gravity or by means of a feeding device. The cutting blade 3 rotates at a high speed, so that individual slices 5 of the food product 4 are cut off and form a stack 6 of slices 5. The stack 6 is the product portion 7 of a food product.

The cutting device 1 can be especially designed to slice several food products 4 in parallel. Furthermore, the speed of the cutting blade 3 and the feed rate of the food product 4 on the support 2 can be accurately controlled so that a desired slice thickness is essentially reached for the individual slices 5. The food products 4 are in particular food bars, such as cheese bars, sausage bars and the like. The food bars can have a length of 2 m. Alternatively, the food products 4, however, can also be food products with a natural shape, such as ham.

A camera 12 can be provided which detects the stack 6, or the uppermost slice 5, respectively. From the image information of the camera 12, the size, the texture, the shape and/or the fat content of the individual slices or of selected slices can be determined.

Furthermore, sensors can be provided in the cutting device 1, or other operating parameters can be detected thereby, such as the cutting pressure of the cutting blade 3.

From the values sensor-detected by the weight sensor, the camera and/or the sensors in the cutting device, as well as from the specification from the cutting device 1, in particular the rotational speed of the cutting blade 3 and the advancement of the food product 4, the property of the product portion 7 can then be determined. From this property of the product portion 7, it is then determined what kind of product carrier 13, 14 is to be allocated to the product portion 7.

The product carriers 13, 14 are supplied to the product portions 7 by means of a product carrier feeder system 15, where in the present embodiment, the product carrier feeder system 15 comprises two different product carrier feeders 16, 17. The upstream product carrier feeder 16 provides the product carrier 13, the product carrier feeder 17 arranged downstream provides the product carrier 14. The product carrier feeders 16, 17 are thus arranged each at a different location in the conveying direction. The product carrier feeders 16, 17 are in particular arranged below the conveyor device 11 so that they can arrange the product carriers 13, 14 below the product portions 7. For this, the conveyor device 11 is in the present embodiment 11 divided into three separate conveyors 8, 9, 10 in the form of conveyor belts, where the product carrier feeders 16, 17 are arranged in the respective spacing between the conveyors 8, 9, 10.

The product carrier feeders 16, 17 each have a product carrier memory 18 for one respective type of product carrier 13, 14. The product carrier memory 18 is followed by a conveyor 31 in the form of a conveyor belt and a support 32, which together form a product carrier conveyor. However, any other product carrier conveyor is conceivable, such as the arrangement of two conveyor belts between which the product carriers 13, 14 are guided. At the end of the product carrier conveyor, the product carriers 13, 14 are delivered such that they are placed from below at the respectively intended product portion 7.

The method according to the disclosure according to FIG. 1 begins with a sliceable food product 4, for example in the form of a food bar, being supplied to a cutting blade 3 and cut into a plurality of slices 5. The slices 5 form a respective stack 6 on a conveyor 8 or a respective support. Once a desired amount of a food product 4 is sliced into slices 5 and the stack 6 has the size of the desired product portion 7, the product portion 7 is by means of the conveyor 8 conveyed further. A property of the product portion is determined during the slicing process or afterwards. This property can, for example, be the weight, the size, the shape, the texture, the fat content and/or the slice thickness of the product portion. The property can alternatively also be prescribed by the cutting device 1.

It is determined in dependency of the property of the product portion 7 whether the product portion 7 is combined with a product carrier 13 or with a product carrier 14. If the product portion 7 is to be combined with a product carrier 13, then, if the product portion 7 passes over from the conveyor 8 to the conveyor 9, a product carrier 13 is provided by the product carrier feeder 16 and arranged below the product portion 7, and ther4byus combined with it. Then the product carrier 13 and the product portion 7 together run on the conveyor 9 and pass over to the conveyor 10 where at this stage no product carrier 14 is provided by the product carrier feeder 17. Finally, the product carrier 10 is further conveyed on the conveyor 9, where at this time or at a later stage the product carrier 13 is at least partially folded around the product portion 7.

If, however, a property of the product portion 7 is determined, which conditions that it should be combined with the product carrier 14, then the product portion 7 is transferred by the conveyor 8 onto the conveyor 9, without the product carrier feeder 16 providing a product carrier 13. If the product portion 7 is then by the conveyor 9 passed over onto the conveyor 10, a product carrier is provided by the product carrier feeder 17 which is disposed below the product portion 7 so that the product portion 7 is combined with the product carrier 14.

Finally, the product carrier 14 is at least partially folded around the product portion 7, as is evident in FIG. 1 on the left side.

Advantageously, the product portion 7 rests completely on the product carrier 13, 14. The product carrier 13, 14 is in particular an L-board comprising a base portion 19, a side portion 20 and a cover portion 21. In this, the base portion 19 is advantageously in its area slightly larger than the support area of the product portion 7, the side portion 20 corresponds to the height of the product portion or is slightly higher. The cover portion 21 is smaller than the base portion 19, and thus covers only part of the upper surface of the product portion 7. The base portion 19, the side portion 20 and the cover portion 21 can be separated by fold lines, so that the L-board can be easily folded into the shape shown. The L-board, in particular together the base portion 19, serves to enable a certain stability of the packaging and to be able to attach more sales information on the cover portion 21. The side portion 20 is optional and can be omitted. Then, the cover portion 21 is disposed directly at the base portion 19. The product portion 7 and the product carrier 13, 14 are usually together placed in a fully transparent or partially transparent packaging unit.

Figure 2:
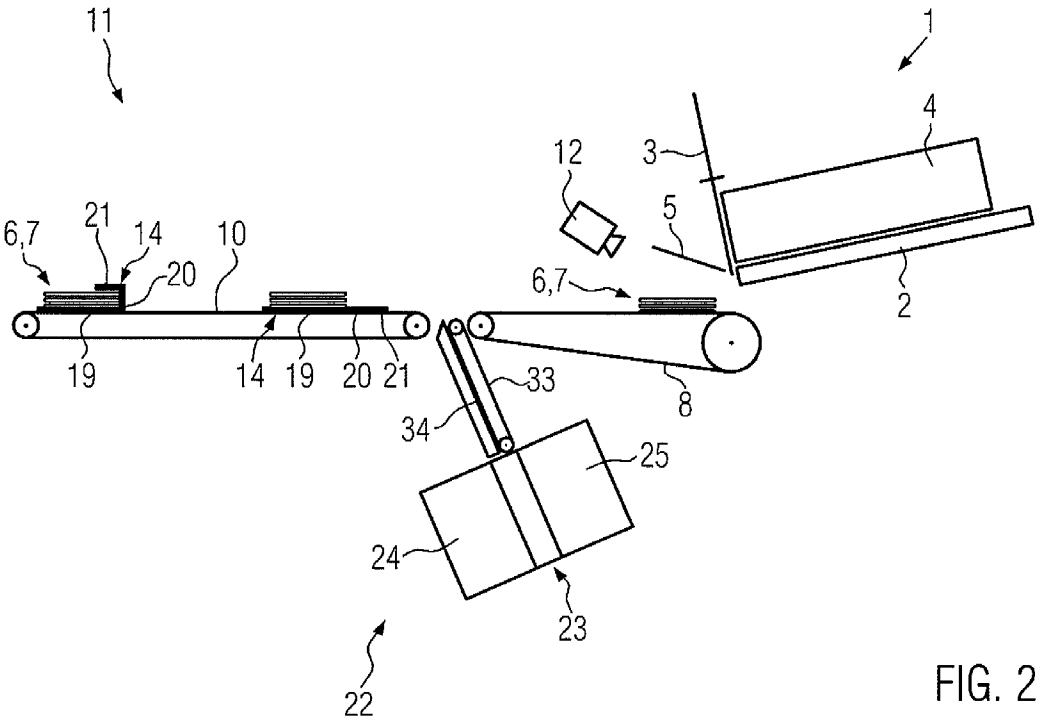
FIG. 2 shows a second embodiment of a food processing device according to the disclosure in a side view.

FIG. 2 shows a second embodiment of the food processing device according to the disclosure. The food processing device also comprises a cutting device 1 having a support 2 and a cutting blade 3 for slicing a food product 4. The resulting slices 5 are stacked downstream of the cutting device 1 and form a product portion 7. The product portion 7 is in turn conveyed on a conveyor 8, in particular a conveyor belt. A camera 12, a weight sensor, or a sensor in the cutting device 1, or the specification from the cutting device 1 are used to determine a property of the product portion 7.

Depending on the property of the product portion 7, either a product carrier 13 or a product carrier 14 is provided by a product carrier feeder system 22. The product carrier feeder system 22 comprises solely one product carrier feeder 23 which is disposed at a location of the conveyor 11. The conveyor device 11 comprises primarily two conveyors 8, 10, in particular in the form of conveyor belts. The product carrier feeder 23 is arranged from below in the spacing between the conveyor 8, 10. The product carrier feeder 23 has a product carrier storage 24 and a product carrier storage 25, where the product carrier storage 24 contains the product carriers 13 and the product carrier storage 25 contains the product carriers 14. Depending on the property of the respective product portion 7, the matching product carrier 13, 14 is then automatically selected by the product carrier feeder 23. This is done in that a corresponding control command is transmitted to the product carrier feeder 23, or that respective properties of the product portion 7 are transmitted to the product carrier feeder 23, which then selects the suitable product carrier 13, 14 using its own control software. The product carrier 13, 14 is by means of a conveyor 33 and a support 34 supplied to the conveyor device 11, so that it is arranged below the product portion 7 and is thus combined with the product portion 7.

The product portions 7 arranged on the product carriers 13, 14 are then conveyed on the conveyor 10. The product carriers 13, 14 are mainly L-boards comprising a base portion 19, a side portion 20 and a cover portion 21, as described above. The product carrier 13, 14 is then together with the product portion 7 further packed into a transparent or partially transparent packaging unit.

The folding process of the L-boards, in which the side portion 20 is raised vis-à-vis the base portion 19, and then the cover portion 21 is folded down upon the product portion 7, can be performed either automatically or manually.

The method according to the embodiment of FIG. 2 again begins in that a food product 4 is in a cutting device 1 sliced into slices 5, which when stacked form a product portion 7. It is directed on a conveyor 8 via a product carrier feeder system 22 with only one product carrier feeder 23. From one of two product carrier storages 24, 25, a suitable product carrier 13, 14 is selected and combined from below with the product portion 7. The product portion 7 together with the product carrier 13, 14 is further conveyed on a conveyor 10, and the product carrier 13, 14 is at least partially folded around the product portion 7.

It is pointed out, that the embodiments of FIG. 1 and FIG. 2 can also be combined, for example, in FIG. 1, two different product carrier feeders 23 can be provided, so that a total of four different product carriers can be provided. Likewise, however, the embodiment of FIG. 2 can also be modified in that more than two product carrier storages are provided which are provided in only one product carrier feeder. This as well can increase the number of different product carriers.

Figure 3:
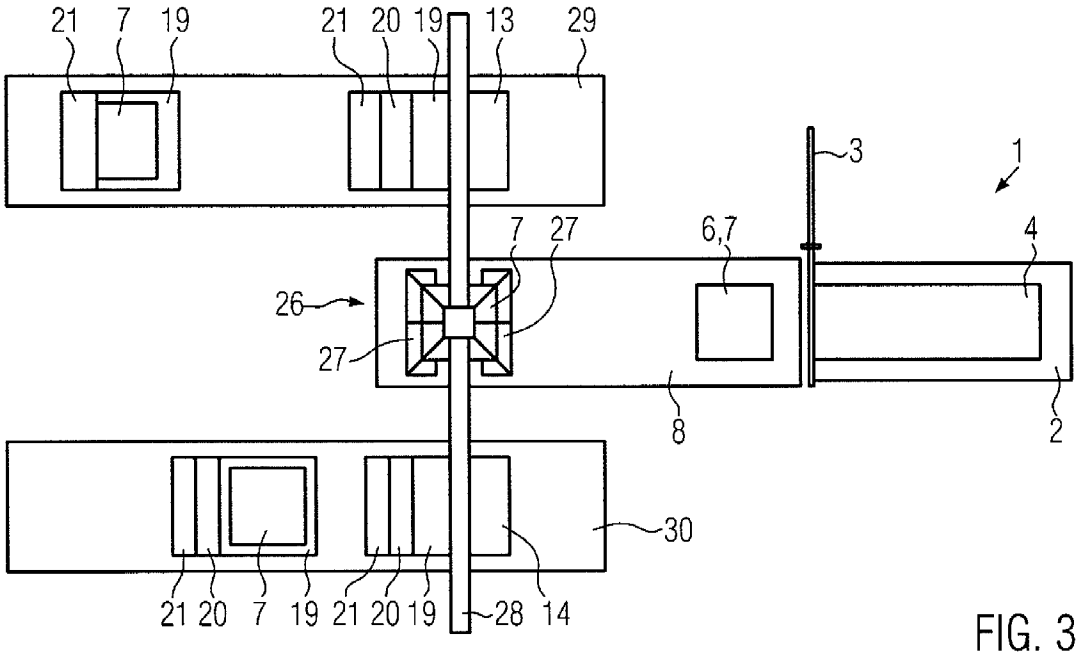
FIG. 3 shows a third embodiment of a food processing device according to the disclosure in a plan view.

FIG. 3 finally shows a third embodiment of a food processing device according to the disclosure. The view in FIG. 3 is, in contrast to FIGS. 1 and 2, no side view but a plan view from above. Similarly as in FIGS. 1 and 2, a cutting device 1 is provided which comprises a support 2 and a cutting blade 3, where a food product 4 rests on the support 2 and is supplied to the cutting blade 3. In this manner, individual slices of the food product 4 are again sliced off, which are supplied to a stack 6, which forms the product portion 7. The stack 6 or the product portion 7 are again arranged on a conveyor 8, or alternatively on a support. When the product portion 7 was placed on a conveyor 8, it can be used to relocate the product portion 7 in the region of a relocation apparatus 26. Alternatively, the relocation apparatus 26 can also be movable so that it receives the product portion 7 directly from a support onto which it is stacked. Again, a property of the product portion 7 was determined by respective sensors or by evaluating the operating variables of the cutting device 1, as already defined above. The relocation apparatus 26 comprises a gripper 27 which can grip underneath the product portion 7 from two sides. Then, the product portion 7 is raised slightly by the relocation apparatus 26 and the gripper 27 is moved along a crossbeam 28.

On both sides of the conveyor 8 or the corresponding support, respectively, conveyors 29, 30 or respective supports are provided. On the conveyor 29, 30, or the respective storage, a respective product carrier 13, 14 of a certain type is provided. A product carrier 13 is in particular provided on the conveyor 29, and a product carrier 14 on the conveyor 30. The relocation apparatus 26 relocates the product portion 7 to the desired product carrier 13, 14 and lowers the product portion 7 thereonto. Then, the product portion 7 is relocated together with the product carrier 13, 14. Finally, the product carrier 13, 14 is folded in the form of an L-board, namely in that the side portion 20 is raised vis-à-vis the base portion 19 and the cover portion 21 is lowered onto the product portion 7.

The method according to the disclosure with respect to the food processing device in FIG. 3 also comprises, that the food product 4 is first in the cutting device 1 sliced into slices 5, which when stacked form a product portion 7. Then, with or without intermediate conveying, the product portion 7 is relocated by a relocation apparatus 26, in particular by a gripper 27, and is arranged on a product carrier 13, 14 according to a predetermined property of the product portion 7. The product carrier 13, 14 is then together with the product portion 7 further conveyed or the product carrier 13, 14 is directly partially folded around the product portion 7 in the shape of an L-board.

Finally, the combination of the folded product carrier 13, 14 and the product portion 7 is further packaged.

A property of the product portion can in particular be its weight. For example, a small L-board can be used for a product portion weighing 100 grams, whereas a large L-board is used for a product portion weighing 250 grams. The different weights can be determined either by weighing, so that correspondingly heavy product portions 7 can be produced. Alternatively, the weight can be directly determined by the number of slices cut from the food product when adjusting the slice thickness for a known diameter of the food product.

Furthermore, in particular for food products having a varying cross-section, camera systems can be provided which determine the size of the product portion 7 and respectively select a suitable L-board.

Cameras or other optical detection systems can also check and classify the food products. For example, the color, the fat percentage, the shape of the product portions or similar properties can be determined and the product portions can then be allocated to different classes, each of which is underlaid with different L-boards. The L-boards can in particular contain different imprints, so that the product portions are sold separately.

The invention claimed is:

1. A method for allocating product carriers to certain types of product portions of a food product, wherein:

during processing of said product portions, at least two different product carriers are available, of which a certain product carrier is respectively combined with a product portion in dependency of a property of said product portion, said product portions transported on a conveyor device and said different product carriers are provided at a location along said conveyor device and in dependency of said property of said respective product portion, a certain product carrier is disposed at said location from below underneath said product portion and further transported with said product portion.

2. The method according to claim 1, wherein said property of said product portion is detected by sensor before said product carrier is combined with said product portion.

3. The method according to claim 1, wherein during a production of said product portion, said property is set, which is considered when said product carrier is combined with said product portion.

4. The method according to claim 1, wherein said property is a size or weight of said product portion and said at least two different product carriers have different sizes.

5. The method according to claim 1, wherein said property of said product portion is detected by means of a camera.

6. The method according to claim 1, wherein a stack of slices forming said product portion is sliced off a food product.

7. The method according to claim 1, wherein said product portions are transported on a conveyor device and said respective different product carriers are each provided at various locations along said conveyor device, and in dependency of said property of said respective product portion, a certain product carrier is disposed at said respective location from below underneath said product portion and further transported with said product portion.

8. The method according to claim 1, wherein said different product carriers are stored at different locations, and wherein said product portions are relocated such that they are respectively combined with said certain product carrier of said different product carriers.

9. A food processing device for product portions of a food product comprising a combining apparatus, in which said product portions are combined with product carriers, comprising:

a product carrier feeder system being designed to respectively combine a certain product carrier of at least two different types of product carriers with said product portion in dependency of a property of said product portions, said food processing device further including a conveyer device being adapted to transport said product portions sequentially in a conveying direction, said product carrier feeder system having only one product carrier feeder being adapted to provide different product carriers from different supplies of product carriers in a product carrier storage, and designed to provide a product carrier, which is combined with a product portion, in dependency of said property of said product portion when the product portion respectively passes said product carrier feeder.

10. The food processing device according to claim 9, where a sensor device is provided being adapted to determine a property of said product portions and to transmit it to said product carrier feeder system.

11. The food processing device according to claim 9, further comprising a cutting device providing stacks of slices of a food product forming said product portions.

12. The food processing device according to claim 11, where a sensor device is provided being adapted to respectively determine at least one property of the individual slices during the cutting process of said cutting device, where the property of said product portion is determined from said properties.

13. The food processing device according to claim 11, where said cutting device is designed to vary the number of slices and/or the thickness of said slices per stack and to transmit said number of slices or the thickness of said slices in said stack as a property of said product portion to said product carrier feeder system.

14. The food processing device according to claim 9, further comprising a conveyor device being adapted to transport said product portions sequentially in the conveying direction, said product carrier feeder system comprising for every type of product carrier one product carrier feeder, which are arranged successively in the conveying direction and are designed to provide a product carrier which is combined with said product portion when a product portion respectively passes said product carrier feeder whose product carrier is to be combined with said product.

15. The food processing device according to claim 9, where said product carrier feeder system makes said different product carriers available at different locations, and a relocation apparatus is provided being designed to relocate said product portion such that it is respectively combined with said specific product carrier of said different product carriers.

* * * * *